US005160000A

United States Patent [19]

Agha et al.

[11] Patent Number: 5,160,000

[45] Date of Patent: Nov. 3, 1992

[54] ATTACHE AND UMBRELLA CARRYING CASE

[76] Inventors: Mary Agha; Zahid Agha, both of 5 Libby Ave., Hicksville, N.Y. 11801

[21] Appl. No.: 836,215

[22] Filed: Feb. 7, 1992

[51] Int. Cl.[5] ..... A45C 13/40

[52] U.S. Cl. ..... 190/102; 116/DIG. 1; 206/459; 340/568

[58] Field of Search ..... 190/102, 111; 206/38, 206/216, 459; 116/200, 220, 307, DIG. 1; 340/540, 568, 691

[56] References Cited

U.S. PATENT DOCUMENTS

| | | | |
|---|---|---|---|
| 3,946,839 | 3/1976 | Butler | 190/102 |
| 3,957,141 | 5/1976 | Domes | 190/102 |
| 4,171,011 | 10/1979 | Koplin | 190/102 |
| 4,887,543 | 12/1989 | Rockhill | 116/307 |
| 5,001,460 | 3/1991 | Basson | 340/691 |
| 5,016,262 | 5/1991 | Cushing | 206/459 |

FOREIGN PATENT DOCUMENTS

| | | | |
|---|---|---|---|
| 1104446 | 11/1955 | France | 206/216 |

*Primary Examiner*—Jimmy G. Foster

[57] ABSTRACT

An attache case with a storage compartment for an umbrella and signalling means for the user to signify when an umbrella is, or is not, in place in the compartment so that inadvertent forgetfulness will not thwart use of the case as intended.

2 Claims, 1 Drawing Sheet

ATTACHE AND UMBRELLA CARRYING CASE

The present invention relates generally to an attache case as typically used for carrying paper contents or the like, but modified according to the present invention to additionally provide storage for an umbrella as when the weather forecast dictates the possible need for same.

EXAMPLE OF THE PRIOR ART

It is already known, as exemplified by U.S. Pat. No. 3,957,141 issued to Norbert Domes on May 18, 1976, that it is advantageous to provide an accessibly available additional compartment for a stored umbrella in a briefcase or like carrying case. Forgetfulness of the user however, will invariably thwart having available an umbrella when needed. To always carry an umbrella is not practical because of its weight, and to rely on "feel" when lifting the case is not reliable because the weight of the paper or other contents might on occasion duplicate the umbrella weight.

It is generally an object of the present invention to provide an attache case with provision for a stored umbrella overcoming the foregoing and other shortcomings of the prior art. More particularly, it is an object to embody an attache-umbrella carrying case with signalling means signifying the presence or absence of an umbrella within the umbrella storage compartment of the case, as well as providing other noteworthy benefits as will be subsequently described in detail.

The description of the invention which follows, together with the accompanying drawings, should not be construed as limiting the invention to the example shown and described, because those skilled in the art to which this invention appertains will be able to devise other forms thereof within the ambit of the appended claims.

Figure 1:
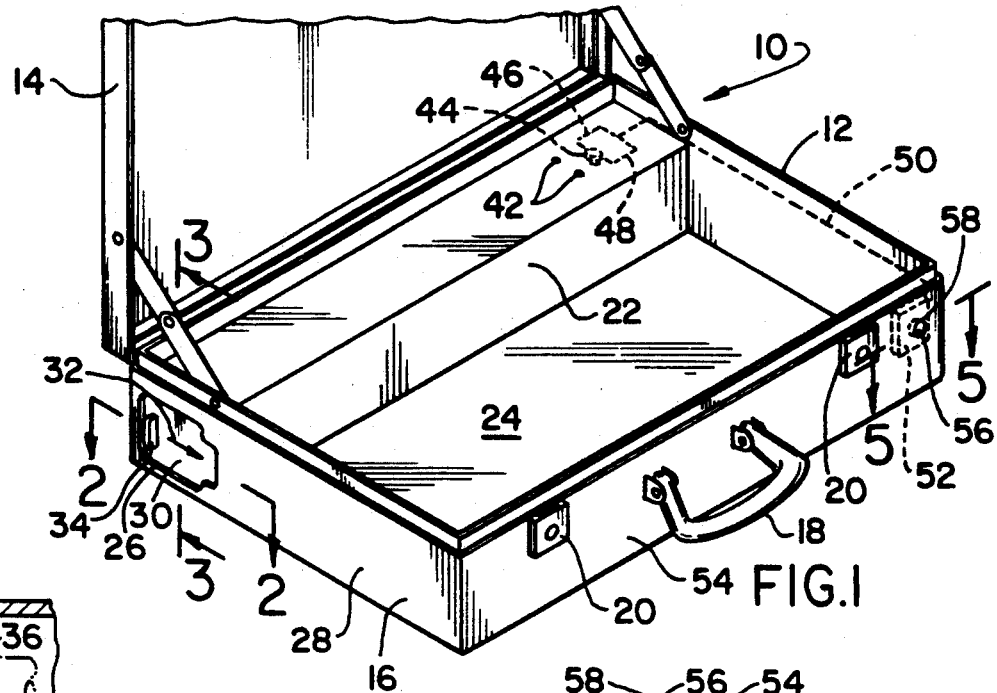
FIG. 1 is a partial perspective view of an attache case modified according to the present invention for storage of an umbrella.
Figure 2:
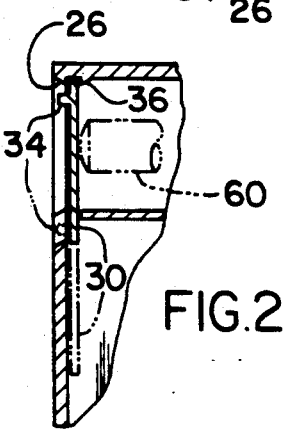
FIG. 2 is a partial sectional taken along line 2—2 of FIG. 1 showing details of the access opening into a storage compartment for said umbrella.

Shown in FIG. 1 is an attache case, generally designated 10, as typically used for storing paper contents (not shown) or the like, but modified according to the present invention to provide storage for an umbrella, as will be subsequently described in detail. From the description which follows, it should be readily understood that provision for an umbrella can also readily be embodied in many types of luggage, carrying cases, briefcases and valises.

Case 10 is rectangular in shape and includes a customary cover section 14 hingedly connected to a body section 16 to which is attached a usual carrying handle 18 and snap locks 20.

The external wall means of body 16 bounds an internal main storage compartment 24 sized to provide adequate space that is usually allocated to accommodate papers, folders, books and the like. Delineated from compartment 24 is a lengthwise oriented compartment 22 that is intended for the storage and convenient carrying of an umbrella 25 of the collapsing or telescoping type. This consequently obviates the user's need to carry an umbrella as a separate item, and also affords the user a convenient place to store a wet umbrella.

Access to compartment 22 is made through an opening 26 in end wall 28 where a sliding panel 30 is moved in the direction of arrow 32. Panel 30 is fitted with a gripping tab 34 and is held in guideways 36. When compartment 22 is vacant and case 12 has the usual vertical (handle side up) attitude, slide panel 30 will seek its closed position by gravity. Panel 30 may optionally also be fitted with latching or locking means (not shown).

Figure 5:
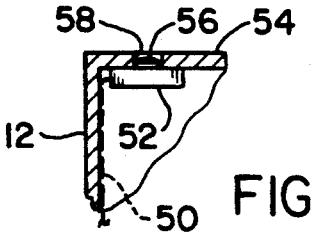
FIG. 5 is a partial cross sectional view taken along line 5—5 of FIG. 1 showing details of a light display signifying the presence or absence of an umbrella within said umbrella storage compartment.
Figure 3:
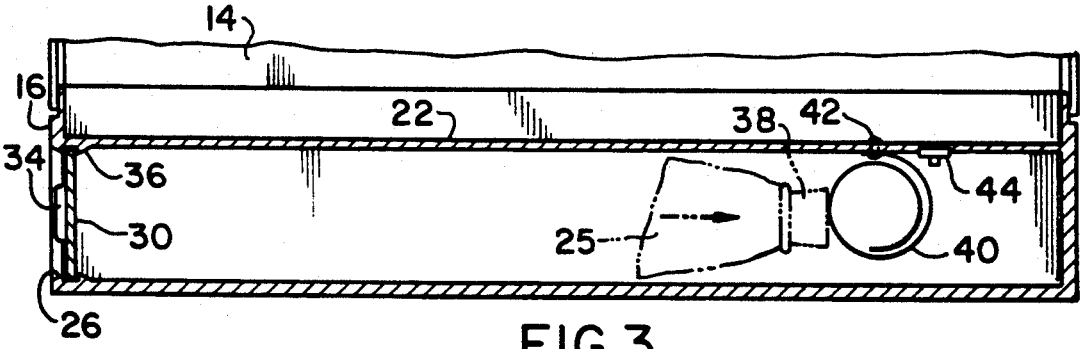
FIG. 3 is a cross sectional view taken along line 3—3 of FIG. 1 showing the umbrella storage compartment when empty and the components signifying this condition to the user.
Figure 4:
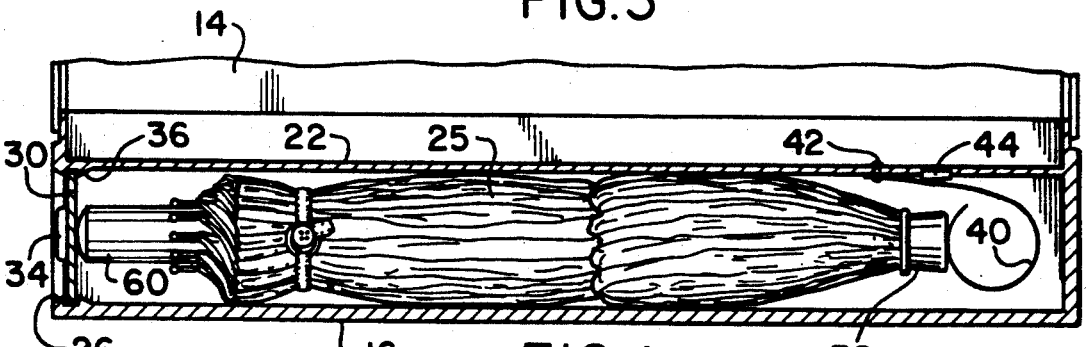
FIG. 4 is a view similar to FIG. 3, but showing the loaded umbrella storage compartment condition signified to the user.

When the user decides to utilize compartment 22, he/she moves panel 30 in the direction of arrow 32 incident to inserting the fully collapsed umbrella 25 through opening 26. At a point during this insertion or umbrella projection, when umbrella 25 is almost completely within compartment 22, the user will encounter a slight resistance as the distal tip or end 38 of umbrella 25 contacts a preformed coil spring 40 (FIG. 3). Coil spring 40 is anchored to housing 22 by a pair of rivets 42, as best seen in FIGS. 1, 3 and 4. Adjacent spring 40 is a normally closed switch 44 that is mounted in compartment 22 at the end remote from opening 26. Switch 44 is electrically connected to a first electrical conductor 46 and to a second electrical conductor 48. Conductors 46 and 48 are combined to form a 2-wire cable 50 which is concealed beneath the lining of case 12. Cable 50 leads to a battery-powered pulsing circuit 52 mounted on the wall 54 of case 12, the construction and operational mode of which is well understood. When switch 44 is closed, as when compartment 22 is empty, circuit 52 provides a pulsed source of electrical power to a light display 56. Display 56 can be any one of many known signaling devices, the one of preference being of the low power consuming LED type. The selected LED signalling device is, for example, the one that is typically used to indicate the ready-to-operate condition of a fire or smoke alarm, which, because of infrequent use, requires such condition to be signified to the user to distinguish from a not ready-to-operate condition. Underlying the present invention is the recognition that this described operating mode of the signalling device 56 is advantageous for use as a reminder to the attache case user to use the umbrella storage compartment 22 when the weather forecast dictates such use. Display 56 is made visible to the user through a necessary port 58 as seen in FIGS. 1 and 5.

A signifiant factor underlaying the present invention is the strategic location of display port 58 adjacent the carrying handle 18, i.e. on the panel to which the handle is attached, since at this location the user cannot fail to take note of the operating mode of the display 56 when reaching for handle 18 incident to using the attache case 10.

In use, as umbrella 25 is pushed and establishes contact against coil spring 40, the coil spring 40 unrolls and presses against switch 44 (FIG. 4), thus causing switch 44 to assume an "open" phase of operation. This established contact between the umbrella distal end 38 and switch 42 via the spring 40 should be readily understood as being a brought-about condition which disables circuit 52 resulting in a cessation or discontinuation of the pulsing of display 56, and this indicates or signifies to the user that compartment 22 is occupied. When umbrella 25 is fully advanced against coil spring 40, panel 30 is moved to its closed position. The constant back force or urgency provided by spring 40 against the umbrella distal tip 38 prevents any rattling about of umbrella 25, and also causes umbrella handle 60 to frictionally keep panel 30 engaged in its closed position.

When the user needs to extract umbrella 25 he/she merely grasps tab 34 and pushes panel 30 in the direction of arrow 32. The urgency of spring 40 then gently forces umbrella 25 through opening 26 as panel 30 assumes its fully open position. After umbrella 25 is partially or completely removed, coil spring 40 returns to the position shown in FIG. 3, and switch 44 resumes its normally closed condition resulting in display 56 resuming its pulsing mode.

Pulsing display 56 serves initially as a reminder for the user to take from home an umbrella 25 if inclement weather is forecast, and subsequently at work to "remember" the whereabouts of umbrella 25 since it is not within compartment 22, and signifies to the user that it should be replaced therein. It has been found in practice that the condition-indicating light display 56 is a noteworthy aspect of the present invention, and that, without the function this component provides, forgetfulness will thwart having available an umbrella when needed. In this regard, to always carry an umbrella is not practical because of its weight, and to rely on "feel" when lifting case 10 is not reliable because on occasion the weight of the other contents in main compartment 24 might duplicate the umbrella weight.

While the attache case, herein shown and disclosed in detail, is fully capable of attaining the objectives and providing the advantages hereinbefore stated, it is to be understood that it is merely illustrative of the presently preferred embodiment of the invention, and that no limitations are intended to the detail of construction or design herein shown other than defined in the appended claims.

What is claimed is:

1. In an attache case of the type having a rectangular body with external wall means bounding an internal main storage compartment for paper contents and having an attached carrying handle, the combination of internal wall means within said body oriented lengthwise thereof to delineate an umbrella storage compartment within said main storage compartment, means providing an external access opening into said umbrella storage compartment, a battery operated signally means electrically connected to normally provide a light display strategically located adjacent said carrying handle to signify to the user the absence of an umbrella within said umbrella storage compartment, and in controlling relation to said signally means a switch means disposed within said umbrella storage compartment at a selected spaced distance remote from said access opening thereinto to cause the establishment of contact between a distal end of an umbrella projected within said umbrella storage compartment and said switch means, whereby said established contact of said umbrella distal end against said switch means results in said light display signifying to the user the presence of an umbrella within said umbrella storage compartment.

2. In an attache case of the type having a rectangular body with external wall means bounding an internal main storage compartment for paper contents and having an attached carrying handle, the combination of internal wall means within said body oriented lengthwise thereof to delineate an umbrella storage compartment within said main storage compartment, means providing an external access opening into said umbrella storage compartment, a battery operated signally means electrically connected to normally provide a light display strategically located adjacent said carrying handle to signify to the user the absence of an umbrella within said umbrella storage compartment, and in controlling relation to said signalling means a normally closed switch means disposed within said umbrella storage compartment at a selected spaced distance remote from said access opening thereinto to cause the establishment of contact between a distal end of an umbrella projected within said umbrella storage compartment and said switch means, whereby said established contact of said umbrella distal end against said switch means opens said switch means and discontinues the operation of said light display to signify to the user the presence of an umbrella within said umbrella storage compartment.

* * * * *